US005911338A

United States Patent [19]

Miller

[11] Patent Number: 5,911,338

[45] Date of Patent: Jun. 15, 1999

[54] ADJUSTABLE CONTAINER

[76] Inventor: Lee D. Miller, 33 Lambourne Road, Barking, Essex 1G11 9PR, United Kingdom

[21] Appl. No.: 09/061,204

[22] Filed: Apr. 16, 1998

[51] Int. Cl.[6] ..... B65D 6/12

[52] U.S. Cl. ..... 220/666; 220/8

[58] Field of Search ..... 220/666, 8

[56] References Cited

U.S. PATENT DOCUMENTS

| | | | |
|---|---|---|---|
| 3,083,877 | 4/1963 | Gash | 220/666 |
| 3,301,293 | 1/1967 | Santelli | 220/666 |
| 5,392,941 | 2/1995 | Robbins, III | 220/666 |
| 5,549,213 | 8/1996 | Robbins, III et al. | 220/666 |
| 5,584,413 | 12/1996 | Jung | 220/666 |

*Primary Examiner*—Joseph M. Moy

[57] ABSTRACT

A new adjustable container for providing a storage container whose volume may be adjusted to suit the size and amount of items held therein. The inventive device includes a base with a perimeter side wall extending around the base outer perimeter to define an interior space. The perimeter side wall has a height (defined between the terminal edge of the perimeter side wall and the base) which is adjustably extendible to increase or decrease the volume of the interior space. A removable lid is provided for substantially covering the opening into the interior space.

4 Claims, 2 Drawing Sheets

ADJUSTABLE CONTAINER

BACKGROUND OF THE INVENTION

1. Field of the Invention

The present invention relates to adjustable volume and collapsible containers and more particularly pertains to a new adjustable container for providing a storage container whose volume may be adjusted to suit the size and amount of items held therein.

2. Description of the Prior Art

The use of adjustable volume containers is known in the prior art. More specifically, adjustable volume and collapsible containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art adjustable volume and collapsible containers include U.S. Pat. No. 4,157,103; U.S. Pat. No. 5,333,761; U.S. Pat. No. 5,407,093; U.S. Pat. No. Des. 347,359; U.S. Pat. No. 5,447,110; and U.S. Pat. No. 4,865,211.

While these devices fulfill their respective, particular objectives and requirements, the aforementioned patents do not disclose a new adjustable container. The inventive device includes a base with a perimeter side wall extending around the base outer perimeter to define an interior space. The perimeter side wall has a height (defined between the terminal edge of the perimeter side wall and the base) which is adjustably extendible to increase or decrease the volume of the interior space. A removable lid is provided for substantially covering the opening into the interior space.

In these respects, the adjustable container according to the present invention substantially departs from the conventional concepts and designs of the prior art, and in so doing provides an apparatus primarily developed for the purpose of providing a storage container whose volume may be adjusted to suit the size and amount of items held therein.

SUMMARY OF THE INVENTION

In view of the foregoing disadvantages inherent in the known types of adjustable volume and collapsible containers now present in the prior art, the present invention provides a new adjustable container construction wherein the same can be utilized for providing a storage container whose volume may be adjusted to suit the size and amount of items held therein.

The general purpose of the present invention, which will be described subsequently in greater detail, is to provide a new adjustable container apparatus and method which has many of the advantages of the adjustable volume and collapsible containers mentioned heretofore and many novel features that result in a new adjustable container which is not anticipated, rendered obvious, suggested, or even implied by any of the prior art adjustable volume and collapsible containers, either alone or in any combination thereof.

To attain this, the present invention generally comprises a base with a perimeter side wall extending around the base outer perimeter to define an interior space. The perimeter side wall has a height (defined between the terminal edge of the perimeter side wall and the base) which is adjustably extendible to increase or decrease the volume of the interior space. A removable lid is provided for substantially covering the opening into the interior space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable container apparatus and method which has many of the advantages of the adjustable volume and collapsible containers mentioned heretofore and many novel features that result in a new adjustable container which is not anticipated, rendered obvious, suggested, or even implied by any of the prior art adjustable volume and collapsible containers, either alone or in any combination thereof.

It is another object of the present invention to provide a new adjustable container which may be easily and efficiently manufactured and marketed.

It is a further object of the present invention to provide a new adjustable container which is of a durable and reliable construction.

An even further object of the present invention is to provide a new adjustable container which is susceptible of a low cost of manufacture with regard to both materials and labor, and which accordingly is then susceptible of low prices of sale to the consuming public, thereby making such adjustable container economically available to the buying public.

Still yet another object of the present invention is to provide a new adjustable container which provides in the apparatuses and methods of the prior art some of the advantages thereof, while simultaneously overcoming some of the disadvantages normally associated therewith.

Still another object of the present invention is to provide a new adjustable container for providing a storage container whose volume may be adjusted to suit the size and amount of items held therein.

Yet another object of the present invention is to provide a new adjustable container which includes a base with a perimeter side wall extending around the base outer perimeter to define an interior space. The perimeter side wall has a height (defined between the terminal edge of the perimeter side wall and the base) which is adjustably extendible to increase or decrease the volume of the interior space. A removable lid is provided for substantially covering the opening into the interior space.

Still yet another object of the present invention is to provide a new adjustable container that have its storage capacity changed according to the increasing or decreasing volume of the contents stored in it.

Even still another object of the present invention is to provide a new adjustable container that has a lid that forms a substantially air tight seal to maintain the size of the container with the help of air pressure in the container.

Yet even still another object of the present invention is to provide a new adjustable container that allows a user to have a container than suits a wide variety of storage needs and helps eliminate the need for variously sized containers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
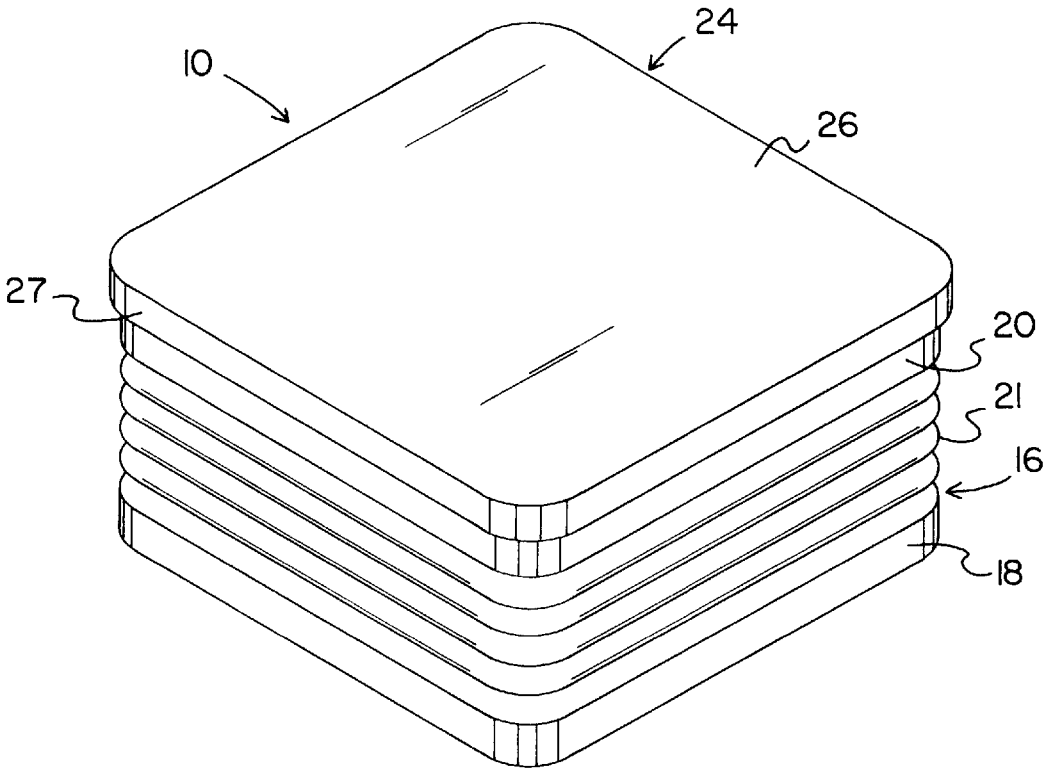
FIG. 1 is a schematic perspective view of a new adjustable container according to the present invention.
Figure 2:
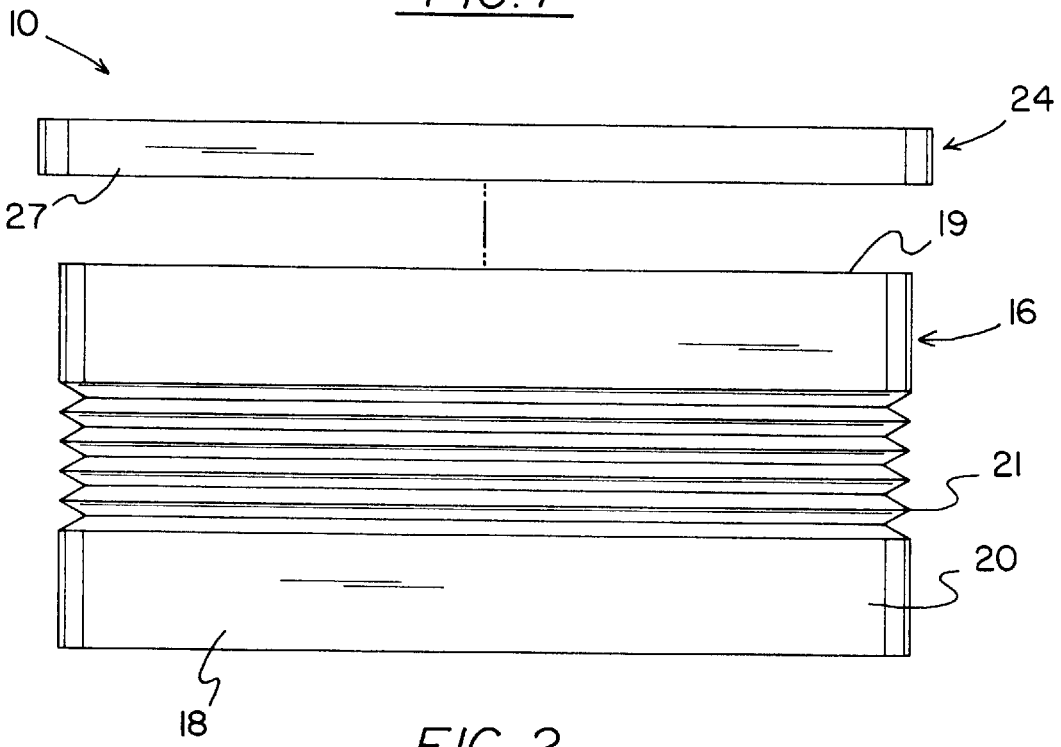
FIG. 2 is a schematic exploded side view of the present invention.

With reference now to the drawings, and in particular to FIGS. 1 through 4 thereof, a new adjustable container embodying the principles and concepts of the present invention and generally designated by the reference numeral 10 will be described.

As best illustrated in FIGS. 1 through 4, the adjustable container 10 generally comprises a base 12 with a perimeter side wall 16 extending around the base 12 outer perimeter to define an interior space. The perimeter side wall 16 has a height (defined between the terminal edge 19 of the perimeter side wall 16 and the base 12) which is adjustably extendible to increase or decrease the volume of the interior space. A removable lid 24 is provided for substantially covering the opening into the interior space.

In closer detail, the base 12 is generally rectangular and has generally planar first and second surfaces 13,14. The base 12 also has a pair of lateral sides and a pair of longitudinal sides extending between the lateral sides of the base 12 with a corner being formed between each intersection of adjacent lateral and longitudinal sides. Together, the lateral and longitudinal sides of the base 12 defining a base outer perimeter. Ideally, the lengths of the lateral sides of the base 12 are substantially equal to the lengths of the longitudinal sides of the base 12 so that the base is generally square in shape.

Figure 3:
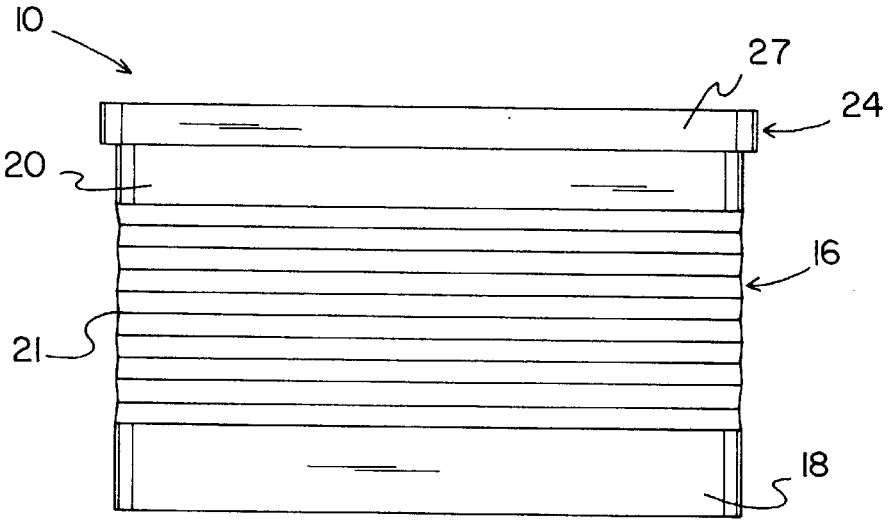
FIG. 3 is a schematic side view of the present invention.
Figure 4:
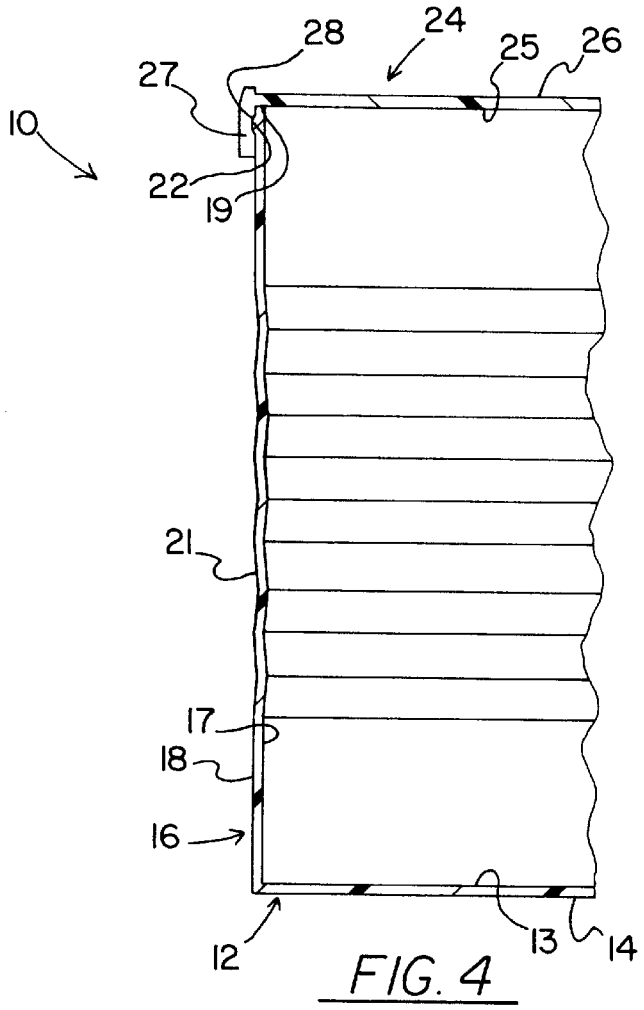
FIG. 4 is a schematic partial sectional view of the present invention.

The perimeter side wall 16 is outwardly extended from first surface 13 of the base 12 around the base outer perimeter. The perimeter side wall 16 defines the interior space of the container. The interior space is designed for containing items in it. The perimeter side wall 16 has inner and outer surfaces, a terminal edge 19, and preferably a plurality of rectangular side panels 20 with a corner edge located between each adjacent pairs of the side panels 20. The terminal edge 19 of the perimeter side wall 16 defines an opening into the interior space. The perimeter side wall 16 has a height which is defined between the terminal edge 19 of the perimeter side wall 16 and the base 12. The height is adjustably extendible such that the volume of the interior space may be adjustably increased and decreased. To permit this adjustable extension of the perimeter side wall 16, the perimeter side wall 16 preferably has a pleated portion 21 extending around it. The pleated portion 21 has a plurality of longitudinal folds that are arranged in an accordion fashion between the base 12 and the terminal edge 19 of the perimeter side wall 16. With reference to FIG. 3, the perimeter side wall 16 has a sealing ridge 22 extending around it, preferably from the outer surface 18 of the perimeter side wall 16. The sealing ridge 22 is preferably located adjacent the terminal edge 19 of the perimeter side wall 16.

The removable lid 24 substantially covers the opening into the interior space. The lid 24 is generally rectangular and has an outer perimeter, inner and outer surfaces 25,26, and a plurality of corners. In the preferred embodiment of the invention, the corners of the base 12 and lid 24 are rounded as well as the corners edges of the perimeter side wall 16.

The outer perimeter of the lid 24 has a lip 27 which is extended around it. A first portion of the lip 27 is outwardly extended from the inner surface 25 of the lid 24 while preferably, a second portion of the lip 27 outwardly extends from the outer surface 26 of the lid 24. The first portion of the lip 27 is positionable adjacent the outer surface of the perimeter side wall 16 around the terminal edge 19 of the perimeter side wall 16 when the lid 24 is covering the opening into the interior space. In the preferred embodiment, the first portion of the lip 27 has a groove 28 extending around it which is matingly engagable to the ridge 22 of the perimeter side wall 16 when the lid 24 is covering the opening into the interior space. This engagement forms a substantially air tight seal between the groove 28 and the ridge. This air tight seal helps to hold the height of the perimeter side wall 16 in place by air pressure in the interior space. The second portion of the lip 27 is adapted for accepting a base 12 of another the container therein such that a plurality of the containers 10 may be easily stacked upon each other.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A container, comprising:

a base having first and second surfaces, and a base outer perimeter;

a perimeter side wall being extended from first surface of said base around said base outer perimeter, said perimeter side wall defining an interior space, said perimeter side wall having inner and outer surfaces, a terminal edge, said terminal edge of said perimeter side wall defining an opening into said interior space, said opening being substantially coextensive with the base outer perimeter to provide maximum access to said interior space;

said perimeter side wall having a height being defined between said terminal edge of said perimeter side wall and said base, said perimeter side wall having at least three pleated portions extending along said perimeter side wall such that said height is adjustably extendible to at least three height sizes; and a removable lid substantially covering said opening into said interior space, said lid having an outer perimeter and inner and outer surfaces, said lid being substantially coextensive with said base outer perimeter;

wherein said base is generally rectangular and has a pair of lateral sides, a pair of longitudinal sides, and a plurality of corners, each of said corners being located at an intersection between adjacent lateral and longitudinal sides, said lateral and longitudinal sides of said base defining said base outer perimeter, wherein, said perimeter side wall has a plurality of side panels, and a plurality of corner edges, each of said corner edges being located between adjacent pairs of said side panels of said perimeter side wall, said terminal edge of said perimeter side wall defining an opening into said interior space, said side panels being generally rectangular; and wherein said lid is generally rectangular and has a plurality of corners;

wherein said outer perimeter of said lid has a lip being extended therearound, a first portion of said lip being downwardly extended from said inner surface of said lid, a second portion of said lip being upwardly extended from said outer surface of said lid, said first and second portions of said lip lying in the same plane and being substantially perpendicular to said outer surface of said lid, said first portion of said lip being positionable adjacent said outer surface of said perimeter side wall around said terminal edge of said perimeter side wall when said lid is covering said opening into said interior space, said second portion of said lip being adapted for accepting a base of another said container therein such that a plurality of said containers may be stacked upon each other;

wherein said perimeter side wall has a sealing ridge being extended therearound, said sealing ridge being extended from said outer surface of said perimeter side wall, wherein said outer perimeter of said lid has a lip being extended therearound, a first portion of said lip being extended from said inner surface of said lid, said first portion of said lip being positionable adjacent said outer surface of said perimeter side wall around said terminal edge of said perimeter side wall when said lid is covering said opening into said interior space;

wherein said first portion of said lip has a groove extending therearound, said groove of said first portion of said lip being matingly engagable to said ridge of said perimeter side wall when said lid is covering said opening into said interior space to form a substantially air tight seal between said groove and said ridge;

wherein said sealing ridge is located adjacent said terminal edge of said perimeter side wall;

wherein a second portion of said lip is extended from said outer surface of said lid.

2. The container of claim 1 wherein the lengths of said lateral sides of said base are substantially equal to the lengths of said longitudinal sides of said base.

3. The container of claim 1 wherein said corners of said base are rounded, wherein said corners edges of said perimeter side wall are rounded, and wherein said corners of said lid are rounded.

4. A container, comprising:

a base being generally rectangular and having first and second surfaces, a pair of lateral sides, a pair of longitudinal sides, and a plurality of corners, each of said corners being located at an intersection between adjacent lateral and longitudinal sides, said first and second surfaces being generally planar, said lateral and longitudinal sides of said base defining a base outer perimeter;

wherein the lengths of said lateral sides of said base are substantially equal to the lengths of said longitudinal sides of said base;

a perimeter side wall being extended from first surface of said base around said base outer perimeter, said perimeter side wall defining an interior space, said perimeter side wall having inner and outer surfaces, a terminal edge, a plurality of side panels, and a plurality of corner edges, each of said corner edges being located between adjacent pairs of said side panels of said perimeter side wall, said terminal edge of said perimeter side wall defining an opening into said interior space, said opening being substantially coextensive with the base outer perimeter to provide maximum access to said interior space, said side panels being generally rectangular;

said perimeter side wall having a height being defined between said terminal edge of said perimeter side wall and said base, said height being adjustably extendible such that the volume of said interior space may be adjustably increased and decreased, wherein said perimeter side wall has at least three pleated portion being extended therearound, such that said height of said perimeter side wall is adjustably extendible to at least three height sizes;

said perimeter side wall having a sealing ridge being extended therearound, said sealing ridge being outwardly extended from said outer surface of said perimeter side wall, said sealing ridge being located adjacent said terminal edge of said perimeter side wall;

a removable lid substantially covering said opening into said interior space, said lid being generally rectangular and having an outer perimeter, inner and outer surfaces, and a plurality of corners;

said outer perimeter of said lid having a lip being extended therearound, a first portion of said lip being downwardly extended from said inner surface of said lid, a second portion of said lip being upwardly extended from said outer surface of said lid, said first portion of said lip being positionable adjacent said outer surface of said perimeter side wall around said terminal edge of said perimeter side wall when said lid is covering said opening into said interior space;

said first and second portions of said lip lying in the same plane and being substantially perpendicular to said outer surface of said lid;

said first portion of said lip having a groove extending therearound, said groove of said first portion of said lip being matingly engagable to said ridge of said perimeter side wall when said lid is covering said opening into said interior space to form a substantially air tight seal between said groove and said ridge;

said second portion of said lip being adapted for accepting a base of another said container therein such that a plurality of said containers may be stacked upon each other; and wherein said corners of said base are rounded, wherein said corners edges of said perimeter side wall are rounded, and wherein said corners of said lid are rounded.

* * * * *